US005380234A

United States Patent [19]

Ledford

[11] Patent Number: 5,380,234

[45] Date of Patent: Jan. 10, 1995

[54] INFLATABLE AND DEFLATABLE COMBATANT ACTION TOY

[76] Inventor: Kevin D. Ledford, 1857 E. Marion St., #8, Shelby, N.C. 28152

[21] Appl. No.: 249,133

[22] Filed: May 25, 1994

[51] Int. Cl.[6] ..... A63H 3/06; A63H 13/06

[52] U.S. Cl. ..... 446/223; 446/362; 446/4; 273/85 R

[58] Field of Search ..... 446/333-336, 446/4, 226, 223, 220, 362; 273/85 R, 85 H, 85 F

[56] References Cited

U.S. PATENT DOCUMENTS

| | | | |
|---|---|---|---|
| 2,393,289 | 1/1946 | Carlsen | 446/334 |
| 3,848,357 | 11/1974 | Morrison | 446/223 |
| 3,864,870 | 2/1975 | Breslow et al. | 446/334 |
| 4,367,875 | 1/1983 | Barlow et al. | 273/85 F |
| 4,457,097 | 7/1984 | Miller et al. | 446/327 |

*Primary Examiner*—Mickey Yu
*Attorney, Agent, or Firm*—John R. Flanagan

[57] ABSTRACT

An inflatable and deflatable combatant action toy includes a rigid support base, a flexible body having an inflatable and deflatable bladder therein, a pair of pivotal arms manually actuatable for delivering an impact force to another similar combatant action toy, and an air inflation support system. The bladder of the flexible body is inflatable and deflatable respectively upon supply therein and discharge therefrom of a gas under pressure. The flexible body is attached upon the rigid support base. The air inflation support system includes an air nozzle attached on the support base and a lower portion of the flexible body, a protusion element attached on an upper portion of the flexible body, a plug element attached on the protrusion element, a first flexible hollow tube connected to the air nozzle for delivering pressurized air from an external source thereof, such as a pump, through the air nozzle and into the flexible body to inflate the same, and a second flexible hollow tube extending between and detachably interconnecting the plug element on the protrusion element on the upper portion of the flexible body to the air nozzle on the lower portion of the flexible body such that delivery of an impact force of sufficient magnitude to the protrusion element can cause the second flexible tube to detach from the plug and permit deflation of the flexible body.

20 Claims, 2 Drawing Sheets

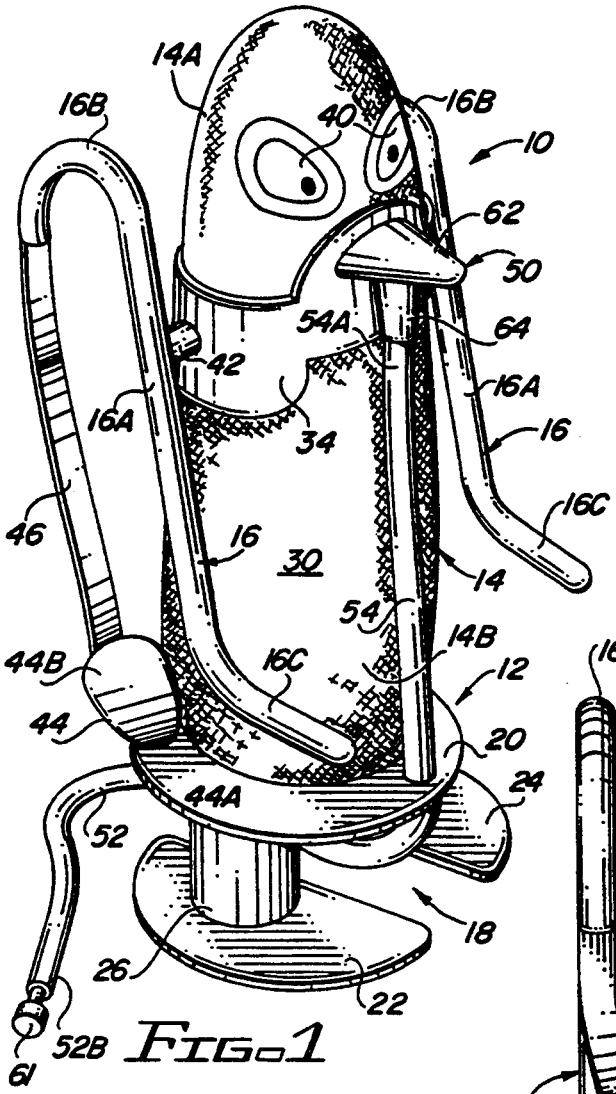
FIG. 1
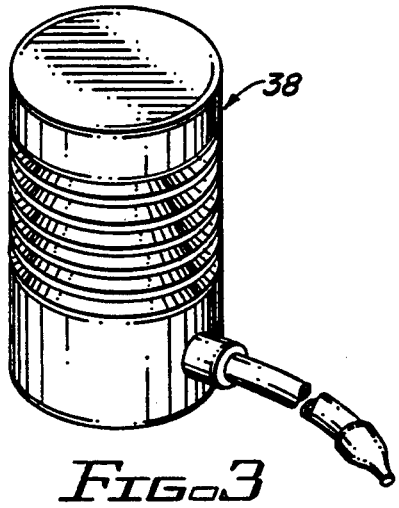
FIG. 3
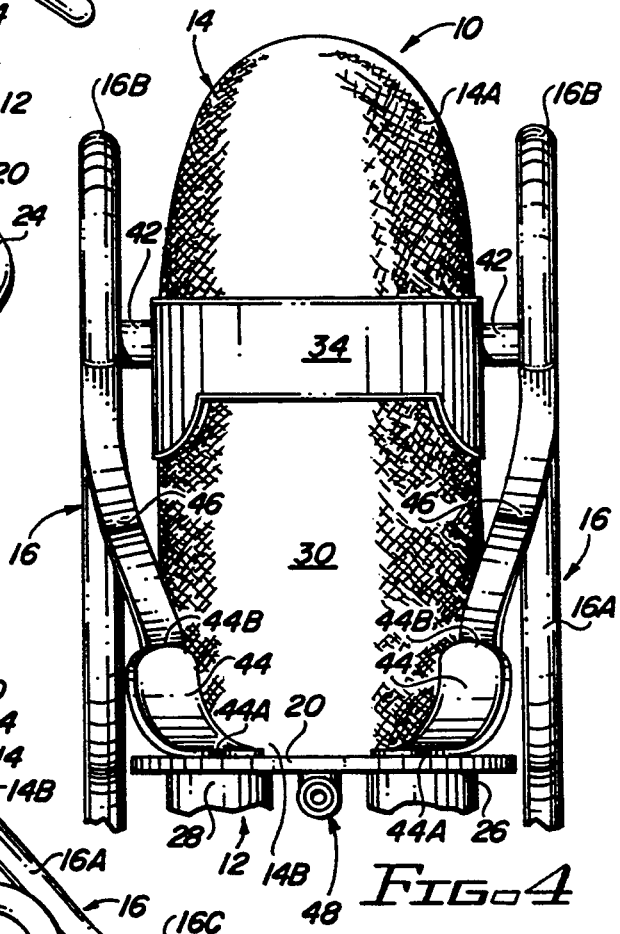
FIG. 4
FIG. 2
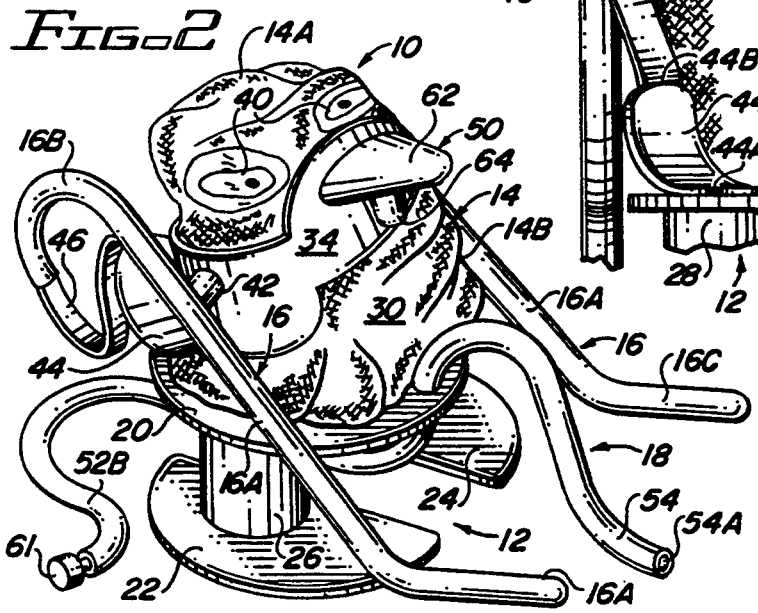

INFLATABLE AND DEFLATABLE COMBATANT ACTION TOY

BACKGROUND OF THE INVENTION

1. Field of the Invention

The present invention generally relates to amusement devices and, more particularly, is concerned with an inflatable and deflatable combatant action toy.

2. Description of the Prior Art

Competitive amusement devices operable by two or more opponents provide a popular pastime for both children and adults. Many such devices take the form of boxers or gladiators and the like in a combative mode. A contest may thereby be presented whereby two or more opponents each operate one such device to inflict a striking force against one another. Such force may be delivered to knock down an opposing device, or to separate one portion thereof, such as the head, from another portion. Children especially may expend a good deal of energy in such contests, thereby finding such devices a particularly enjoyable recreation.

Representative examples of such amusement devices are disclosed in U.S. Pat. Nos. to Morrison (3,848,357), Breslow et al (3,864,870), Barlow et al (4,367,875) and Miller et al (4,457,097). Each of these devices provides one or more combative figures having pivotally moveable members for striking at a specific target area on an opposing figure. The Breslow et al and Barlow et al devices each provides a pair of combative figures attached to a single base. The Morrison and Miller et al devices each provides an individual figure having combative capability against one or more similar opponents.

Each of these devices is fairly complex in design and construction and therefore costly to manufacture. Moreover, given the vigorous use to which children typically put such devices, breakage of one or more parts thereof is likely to occur. High replacement costs, therefore, are also to be expected.

Consequently, a need still exists for a combatant action toy which is inexpensive to produce and is sufficiently flexible and resilient for withstanding ordinary wear and tear by energetic children over a reasonably length of time. Such durability would thereby greatly reduce the possibility of breakage of the device and the subsequent costs for replacement thereof.

SUMMARY OF THE INVENTION

The present invention provides an inflatable and deflatable combatant action toy designed to satisfy the aforementioned needs by avoiding the drawbacks of the prior art without introducing other drawbacks. Instead, the inflatable and deflatable combatant action toy of the present invention provides expanded capabilities not available in the prior art devices.

One capability is the simplicity in design and construction of the inflatable and deflatable combatant action toy for inexpensive manufacture thereof. A second capability is the flexibility and durability of the inflatable combatant action toy for providing a reasonably long life for the toy.

Accordingly, the present invention is directed to an inflatable and deflatable combatant action toy which comprises: (a) a support base; (b) a flexible body attached upon the support base and having a bladder with an interior chamber convertable between inflated and deflated conditions respectively upon supply therein and discharge therefrom of pressurized gas; (c) at least one arm connected to the flexible body and being movable relative thereto when the flexible body is in the inflated condition to deliver a blow to another similar combatant action toy; and (d) an inflation support system including (i) means for defining an air nozzle on a lower portion of the flexible body in communication with the interior chamber of the flexible body, (ii) means for defining a plug structure on an upper portion of the flexible body, (iii) a first flexible hollow tube connected to the air nozzle defining means for delivering pressurized air from an external source thereof through the air nozzle and into the flexible body to inflate the flexible body, and (iv) a second flexible hollow tube extending between and detachably interconnecting the air nozzle defining means on the lower portion of the flexible body and the plug structure defining means on the upper portion of the flexible body such that an impact force of sufficient magnitude delivered to the upper portion of the flexible body adjacent to the plug structure defining means can cause the second flexible tube to detach from one of the air nozzle defining means and plug structure defining means and permit deflation of the flexible body.

Further, the plug structure defining means includes a protrusion element attached to and extending outwardly from the upper portion of the flexible body and a plug attached to and projecting from the protrusion element such that an end of the second flexible hollow tube is releasably fitted with the plug and can detach or release therefrom when an impact form of sufficient magnitude is delivered to the protrusion element. The air nozzle includes a connector attached to an annular open mouth of the bladder of the flexible body. The impact force delivering arm also has a manually depressable pedal anchored at one end to the support base and interconnected at an opposite end to an end of the elongated arm such that by depressing the pedal the arm is caused to pivot relative to the flexible body.

Also, the rigid support base includes an upper platform, a pair of spaced lower platforms and a pair of posts extending between and rigidly interconnecting the upper platform and spaced lower platforms in a parallel relation at opposite upper and lower ends of the post. The flexible body and pedals are attached upon the upper platform.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of the inflatable and deflatable combatant action toy of the present invention, being shown in an inflated condition.

FIG. 2 is a perspective view of the combatant action toy of FIG. 1, but shown in a deflated condition.

FIG. 3 is a perspective view of a conventional hand-operated pump (not part of the present invention) for inflating the toy of FIG. 1.

FIG. 4 is a fragmentary rear elevational view of the toy of FIG. 1.

DETAILED DESCRIPTION OF THE INVENTION

Figure 5:
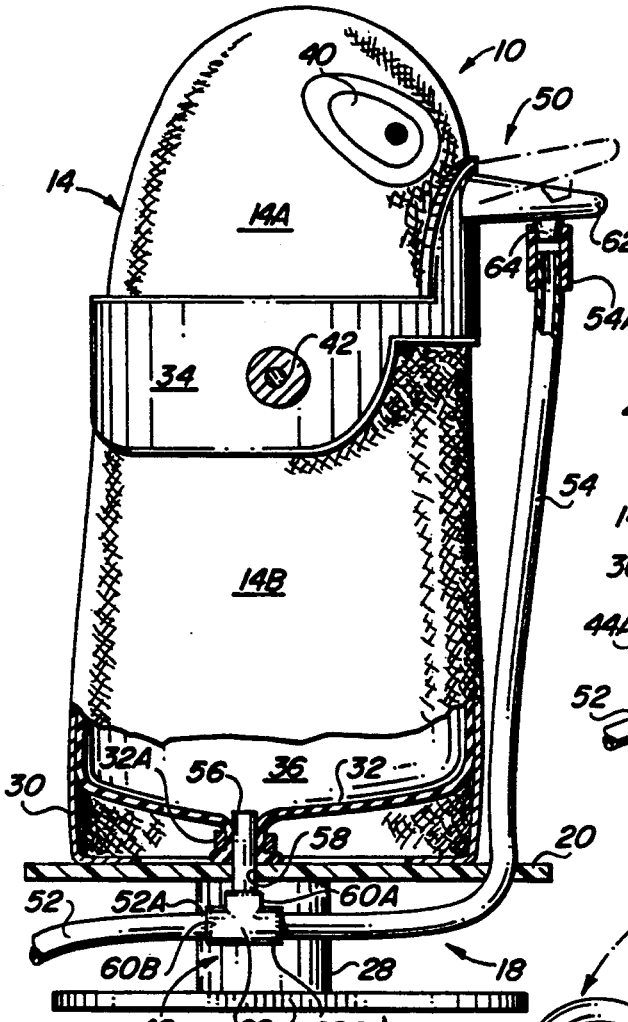
FIG. 5 is an enlarged side elevational view of the toy of FIG. 1, with portions broken away to shown the inflation support system for inflating and deflating the toy of FIG. 1.
Figure 6:
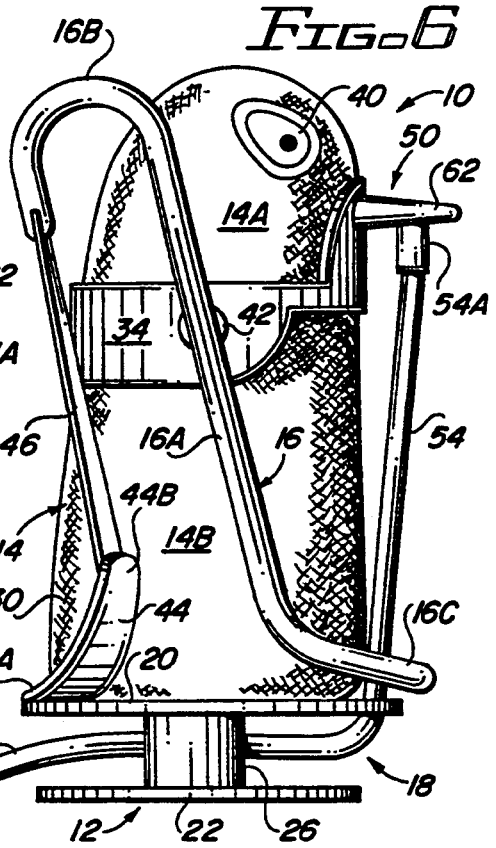
FIG. 6 is a side elevational view of the toy of FIG. 1 in an inflated condition, showing a pivotal arm member in a stationary position.
Figure 7:
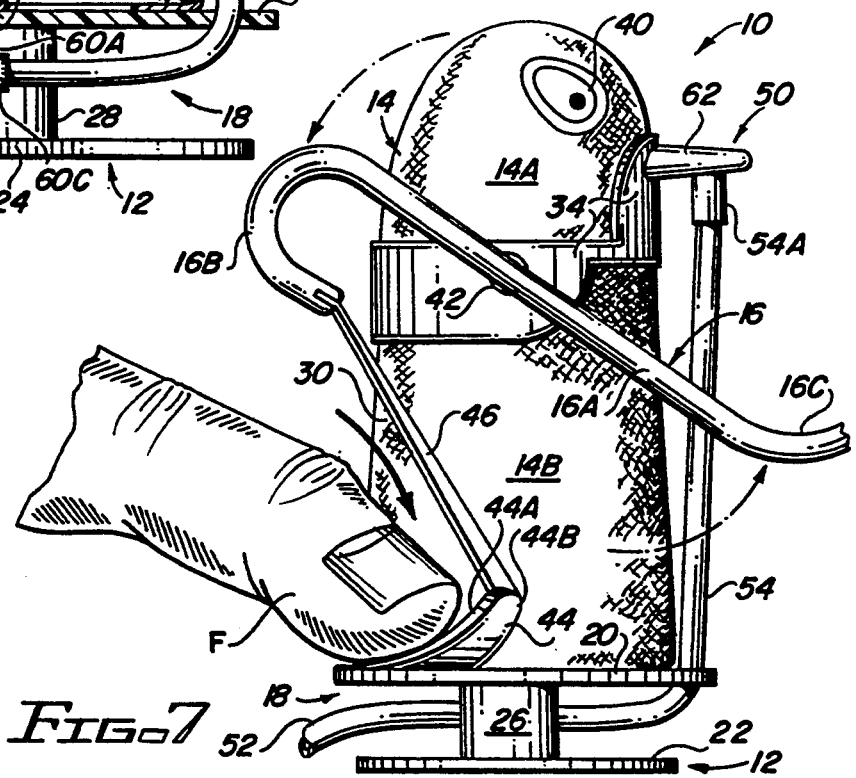
FIG. 7 is a side elevational view of the toy of FIG. 1, showing the toy in an inflated condition and showing directional movement of a pivotal arm member to produce a striking type of motion.

Referring to the drawings, and particularly to FIGS. 1 and 6, there is illustrated an inflatable and deflatable combatant action toy of the present invention, being generally designated 10. Basically, the combatant action toy 10 includes a rigid support base 12, a flexible body 14, a pair of pivotal arms 16 manually actuatable for delivering an impact force to another similar combatant action toy (not shown), and an air inflation support system 18.

Referring to FIGS. 1, 2 and 5–7, the rigid support base 12 of the action toy 10 includes an upper circular platform 20, a pair of laterally spaced lower semi-circular platforms 22, 24 and a pair of posts 26, 28 extending between and rigidly interconnecting the upper platform 20 and the pair of lower platforms 22, 24. The pair of lower platforms 22, 24 are flat in shape and disposed in a common plane and in a parallel relation to the upper platform 20. The spaced lower platforms 22, 24 thus provide a stable base which can be positioned firmly upon a horizontal support surface, such as a table or floor, over which to push and maneuver the toy 10 and actuate its pivotal arms 16 to engage in combat with another similar toy.

Referring to FIGS. 1 and 4–7, the flexible body 14 of the action toy 10 is attached upon the upper platform 20 of the support base 12 and is fabricated of an outer sheath or cover 30 of a suitable flexible material enclosing an inner inflatable and deflatable balloon or bladder 32. The body 14 also includes a circular band 34 of a semi-rigid material attached to and surrounding the outer cover 30 so as to divide the body 14 into upper and lower portions 14A, 14B. The bladder 32 is disposed in a hollow interior chamber 36 defined by the outer cover 30 and is convertable between an inflated condition, as seen in FIGS. 1 and 4–7, and a deflated condition, as seen in FIG. 2, respectively upon supply therein and discharge therefrom of a pressurized gas, such as ordinary air. The bladder 32 can either be permanently installed or replaceable. As seen in FIG. 3, a conventional hand-operated pump 38 (not part of the present invention) can be used for inflating the bladder 32 of the toy 10. The outer cover 30 may replicate the character of an animal or a fictitious or cartoon character wherein eyes 40 are printed or applied on the upper portion 14A of the body 14.

Referring to FIGS. 1 and 4–7, each of the pair of elongated arms 16 of the action toy 10 is pivotally connected by a pivot pin 42 to one of a pair of opposite sides of the rigid band 34. Each arm 16 has an elongated straight middle portion 16A extending between a rounded hook-shaped upper rear end portion 16B and a straight lower front portion 16C extending at a shallow angle forwardly from the middle portion 16A. The pivot pin 42 is connected to the respective arm 16 at a point thereon located on the middle portion 16A between but closer to the hook-shaped rear end portion 16B than to the front portion 16C. Thus, the arms 16 are capable of being pivotally moved relative to the band 34 and flexible body 14 when the bladder 32 of the flexible body 14 is in the inflated condition to deliver an impact force by means of its lower front portion 16C to the another similar combatant action toy.

Further, there is a manually-actuatable pedal 44 associated with each arm 16. Each pedal 44 is anchored at one end 44A to the upper platform 20 of the support base 12 and interconnected at an opposite end 44B via an elongated flexible link 46 to the hook-shaped rear end portion 16B of the respective elongated arm 16. The pedal 44 normally assumes an inclined orientation when the respective arm 16 is at a lowered rest position, as shown in FIG. 6. The normally inclined pedal 44 is actuated by a player placing a hand around the circular platform 20 and by use of a finger F to manually depress the pedal 44 and cause it to pull downward on the rear end portion 16B of the arm 16 via the flexible link 46 and thereby pivotally move the arm 16 so as to raise the forward end portion 16C thereof in an uppercut striking type of motion.

The inflation support system 18 includes an air nozzle defining means 48, a plug structure 50, a first flexible hollow tube 52, and a second flexible hollow tube 54. The air nozzle defining means 48 of the inflation support system 18 includes a short hollow tube 56 mounted through an aperture 58 formed in the upper platform 20 of the support base 12 and coupled with an open mouth 32A on the flexible bladder 32 at the lower portion 14B of the flexible body 14 and a T-shaped connector 60 having one leg 60A connected with the tube 56. The first flexible hollow tube 52 of the inflation support system 18 is connected at one end 52A to another leg 60B of the connector 60 of the air nozzle 48 for delivering pressurized air from an external source, such as the hand-operated pump 38, through the air nozzle 48 and into the interior chamber 36 of the flexible bladder 32 to inflate the bladder 32 and thus the body 14. Once the bladder 32 is inflated, a stopper 61, as seen in FIGS. 1 and 2, can be inserted into the terminal end 52B of the first flexible hollow tube 52.

The plug structure 50 of the inflation support system 18 is attached to a portion of the annular band 34 on the upper portion 14A of the body 14. The plug structure 50 includes a protrusion element 62 attached on and projecting outwardly from an upper portion 14A of the flexible body 14. The protrusion element 62 can replicate a nose or beak associated with the eyes 40 of the character depicted on the flexible body 14. The plug structure 50 also includes a plug element 64 attached to and projecting downwardly from the protrusion element 62. The second flexible hollow tube 54 of the inflation support system 18 extends between and detachably interconnects still another leg 60C of the connector 60 of the air nozzle defining means 48 with the plug element 64 of the plug structure 50. The delivery of an impact force of sufficient magnitude to the protrusion element 62 on the upper portion 14A of the flexible body 14 can cause an upper end 54A of the second flexible hollow tube 54 to detach from the plug element 64 and to permit deflation of the bladder 32 and the flexible body 14 therewith.

Thus, it can be readily understood that deflation of the bladder 32 of the flexible body 14 occurs upon detachment of the second flexible hollow tube 54 from the plug element 64 on the protrusion element 62. The mere weight of the upright flexible body 14 and bladder 32 and arms 16 mounted thereon are sufficient to cause deflation and collapse thereof and explusion of the air upon detachment of the second flexible hollow tube 54 by the impact force of an uppercut blow planted on the protrusion element 62 of the one combatant action toy 10 by the "fist" end portion 16C of the arm 16 of an opposing combatant action toy.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. An inflatable and deflatable combatant action toy, comprising:

(a) a support base;

(b) a flexible body attached upon said support base and having a hollow interior chamber convertable between inflated and deflated conditions respectively upon supply therein and discharge therefrom of a gas under pressure;

(c) means connected to said flexible body for delivering an impact force to another similar combatant action toy; and (d) an inflation support system including (i) means for defining an air nozzle on a lower portion of said flexible body in communication with said interior chamber of said flexible body, (ii) means connected to said air nozzle defining means for delivering pressurized air from an external source thereof through said air inlet nozzle and into said flexible body to inflate said flexible body, (iii) means attached to an upper portion of said flexible body and protruding therefrom for defining a plug structure; and (iv) means extending between and detachably interconnecting said air nozzle defining means on said lower portion of said flexible body and said plug structure defining means on said upper portion of said flexible body such that an impact force of sufficient magnitude delivered to said plug structure defining means can cause said interconnecting means to detach from one of said plug structure defining means and said air nozzle defining means and permit deflation of said flexible body.

2. The toy of claim 1 wherein said plug structure defining means includes a protrusion element attached to and extending outwardly from said upper portion of said flexible body and a plug element attached to and projecting downwardly from said protrusion element such that an end of said interconnecting means is releasably fitted with said plug element.

3. The toy of claim 1 wherein said interconnecting means is a first elongated flexible hollow tube.

4. The toy of claim 3 wherein said plug structure defining means includes a protrusion element attached to and extending outwardly from said upper portion of said flexible body and a plug element attached to and projecting from said protrusion element such that an end of said first elongated flexible hollow tube is coupled with said plug element.

5. The toy of claim 4 wherein said flexible body includes an inflatable and deflatable bladder having an annular open mouth.

6. The toy of claim 5 wherein said air nozzle defining means includes a connector having one leg interconnected with said annular mouth of said bladder and another leg connected with an opposite end of said first elongated flexible hollow tube.

7. The toy of claim 6 wherein said pressurized air delivering means is a second elongated flexible hollow tube coupled at one end to still another leg of said connector.

8. The toy of claim 1 wherein said flexible body includes an inflatable and deflatable bladder having an annular open mouth.

9. The toy of claim 8 wherein said air nozzle defining means includes a connector having one leg interconnected with said annular mouth of said bladder and another leg connected with an opposite end of said interconnecting means.

10. The toy of claim 9 wherein said pressurized air delivering means is an elongated flexible hollow tube coupled at one end to still another leg of said connector.

11. The toy of claim 1 wherein said impact force delivering means includes at least one elongated member connected to said flexible body and being movable relative thereto when said flexible body is in said inflated condition to deliver said impact force to said another similar combatant action toy.

12. The toy of claim 11 wherein said impact force delivering means also includes a manually depressable pedal anchored at one end to said support base and interconnected at an opposite end to an end of said elongated member.

13. The toy of claim 1 wherein said impact force delivering means includes a pair of elongated arms each being pivotally connected at a location thereon between opposite ends thereof to one of a pair of opposite sides of said flexible body and being pivotally movable relative thereto when said flexible body is in said inflated condition to deliver said impact force to said another similar combatant action toy.

14. An inflatable and deflatable combatant action toy, comprising:

(a) a rigid support base;

(b) a flexible body attached upon said rigid support base and having an inner bladder convertable between inflated and deflated conditions respectively upon supply therein and discharge therefrom of a pressurized gas;

(c) a pair of elongated arms each being pivotally connected at a location thereon between opposite ends thereof to one of a pair of opposite sides of said flexible body and being pivotally movable relative thereto when said flexible body is in said inflated condition to deliver an impact force to another similar combatant action toy;

(d) a pair of pedals each being anchored at one end to said support base and interconnected at an opposite end to an end of one of said elongated arms and being actuated by manually depressing said pedal to cause said pivotal movement of said respective arm; and (e) an inflation support system including (i) an air nozzle attached on a lower portion of said flexible body in communication with said bladder of said flexible body, (ii) a protrusion element attached on and projecting outwardly from an upper portion of said flexible body, (iii) a plug element attached on said protrusion and extending downwardly therefrom, (iv) means connected to said air nozzle for delivering pressurized air from an external source thereof through said air nozzle and into said bladder of said flexible body to inflate said bladder and said flexible body therewith, and (v) an elongated flexible hollow tube extending between and detachably interconnecting said air nozzle and said plug element on said protrusion element such that delivery of an impact force of sufficient magnitude to said protrusion element on said upper portion of said flexible body can cause an end of said elongated flexible tube to detach from said plug element and permit deflation of said bladder and flexible body.

15. The toy of claim 14 wherein said bladder has an annular open mouth.

16. The toy of claim 15 wherein said air nozzle defining means includes a connector having one leg interconnected with said annular open mouth of said bladder and another leg connected with an opposite end of said flexible hollow tube.

17. The toy of claim 16 wherein said pressurized air delivering means is an elongated flexible hollow tube coupled at one end to still another leg of said connector.

18. The toy of claim 14 wherein said rigid support base includes an upper platform and a pair of lower spaced platforms.

19. The toy of claim 18 wherein said rigid support base also includes a pair of posts extending between and interconnecting said upper platform and said pair of lower platforms.

20. The toy of claim 18 wherein said flexible body is attached upon said upper platform.

* * * * *